United States Patent [19]

Ekholm

[11] 4,009,726

[45] Mar. 1, 1977

[54] DEVICE FOR ELONGATE SOAKING BASINS

[75] Inventor: Rolf Ekholm, Nyland, Sweden

[73] Assignee: AB Hammars Mekaniska Verkstad, Nyland, Sweden

[22] Filed: Sept. 19, 1975

[21] Appl. No.: 614,884

[30] Foreign Application Priority Data

Oct. 7, 1974 Sweden ..... 7412584

[52] U.S. Cl. ..... 134/46; 134/134; 118/423

[51] Int. Cl.[2] ..... B08B 3/04

[58] Field of Search ..... 134/133–134, 134/154, 165, 182–183, 46; 118/423

[56] References Cited

UNITED STATES PATENTS

| | | | |
|---|---|---|---|
| 620,820 | 3/1899 | Zies | 134/133 |
| 755,626 | 3/1904 | Danner | 134/134 |
| 1,565,297 | 12/1925 | Varney | 134/165 X |
| 2,092,938 | 9/1937 | Stebler | 134/133 X |
| 3,771,652 | 11/1973 | Rousselie et al. | 134/133 X |

FOREIGN PATENTS OR APPLICATIONS

| | | | |
|---|---|---|---|
| 235,909 | 6/1911 | Germany | 134/104 |
| 237,393 | 8/1911 | Germany | 165/ |

*Primary Examiner*—Robert L. Bleutge
*Attorney, Agent, or Firm*—Silverman & Cass, Ltd.

[57] ABSTRACT

An elongate soaking basin has a screen mounted on a movable frame. The screen is vertically movable into and out of the soaking basin. The soaking basin has a compression wheel feeding pieces of lumber transversely into the soaking basin against the screen. The pieces of lumber are compressed between the screen and the compression wheel. The screen is pivotally supported between two limit positions in the movable frame and when the screen is forced against one of the limit positions, the frame is moved to reposition the screen, thus keeping the pieces of lumber aligned and under the proper compression.

11 Claims, 9 Drawing Figures

22
23
21
21'
24
21'
24
20"
20"
34
36
35
31
37
25
25
40
27
43
26
17
18
12
15
16
13
20
1

22
24
21
38
20''
20'
35
34
33
36
32
31
39
46
47
40
48
45
49
42
29
30
41
28
28
25
25
20''
20'
20
1

DEVICE FOR ELONGATE SOAKING BASINS

The present invention relates to a device for elongate soaking basins for transverse feeding of lumber, preferably pieces of lumber intended for veneer production, in the longitudinal direction of the basin.

In previously known soaking basins the pieces of lumber are laid down more or less manually, and after a certain time in the hot water the pieces of lumber are removed from the basin by some mechanically driven grab means. The whole basin can be filled with pieces of lumber, but manual work is required to handle the pieces of lumber when they are lifted out of the basin. Therefore in some basins a star-wheel rotating about a horizontal shaft is arranged, said wheel being provided with a number of radial arms. The spaces between said arms are filled with pieces of lumber as far as possible. When the wheel is rotated the pieces of lumber will be fed into the hot water of the basin and moved forward a distance, until the pieces of lumber are lifted out of the water. In this case the feeding to, through and out of the basin is partly mechanical, but still a great lot of manual work is required.

It is an object of the present invention to increase the efficiency of soaking basins by providing such a device, that the soaking basins can not only be substantially completely filled with a great number of pieces of lumber, but also that the pieces of lumber can be fed forwards in the longitudinal direction of the basin while remaining in their transverse direction in the basin, without any manual work being required. Furthermore, the device according to the invention can cooperate with a conveyor for feeding pieces of lumber to the device, and also with a conveyor for feeding pieces of lumber from the device, without requiring any other manual work than control of the operation.

The device according to the invention is characterized by the fact, that a compression wheel of a known construction is arranged at the lumber infeeding end of the basin to feed the pieces of lumber forwards in the basin, and that a vertical screen is vertically movable into and out of the basin by a motor supported by a frame. The screen having its plane in the transverse direction of the basin, said frame being driveable above the basin in the longitudinal direction thereof by a driving motor to move the screen to and fro between its initial position at the compression wheel and its end position at the lumber outfeeding end of the basin. Said screen is suitably suspended and vertically displaceably guided in a cradle, said cradle being suspended by horizontal shaft pivots so that it is swingable within certain limits in the frame and carrying a pair of contact members or the like fastened thereto for cooperation during its swinging movement between two end positions with an end position switch connected to the electrically driven motor in the circuit for discontinuous current supply and thereby stepwise feeding of the movable frame and the parts supported thereby to the end position of the frame.

The invention will be illustrated by an embodiment shown as an example in the attached drawings.

Figure 1:
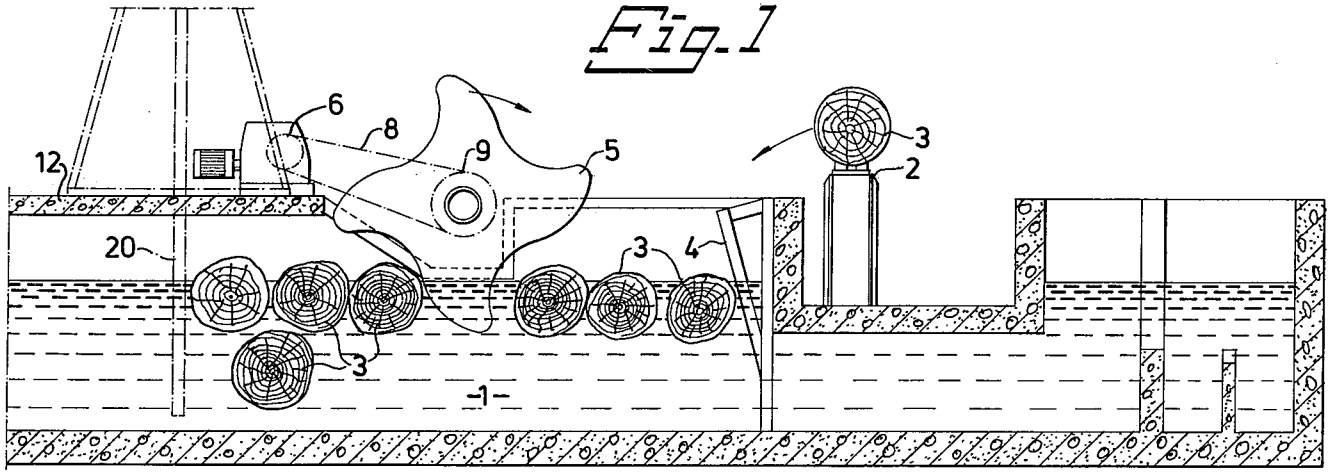
FIG. 1 shows a vertical longitudinal section through one end of a soaking basin according to the invention and the parts arranged at the same.

A basin plant according to the invention comprises several, for example four, soaking basins 1 lying side by side and parallel to each other, said basins having a substantial length, for example about 75 m, and width, for example about 3 m, for three of the basins and about 2 m for the fourth basin. All the basins and their parts are constructed in the same way except for one basin being less wide and thereby certain of its parts having smaller dimensions. Therefore, only one basin is shown in the drawings. The basins communicate with tanks and pumps connected thereto for pumping hot water to and from the basins. This can be done automatically or manually by actuation of certain press buttons. Since the plant is large there are for example three storys at different levels with stairs between them for persons controlling the operation; however, these constructions are not shown in the drawings for the sake of clarity and as they are not included in the invention. As the basin 1 is of a substantial length, FIGS. 1 and 3 only show the right end and FIGS. 2 and 4 only show the left end of the basin. The omitted middle portion, about 60 m, has the same construction as the end portions illustrated.

Figure 3:
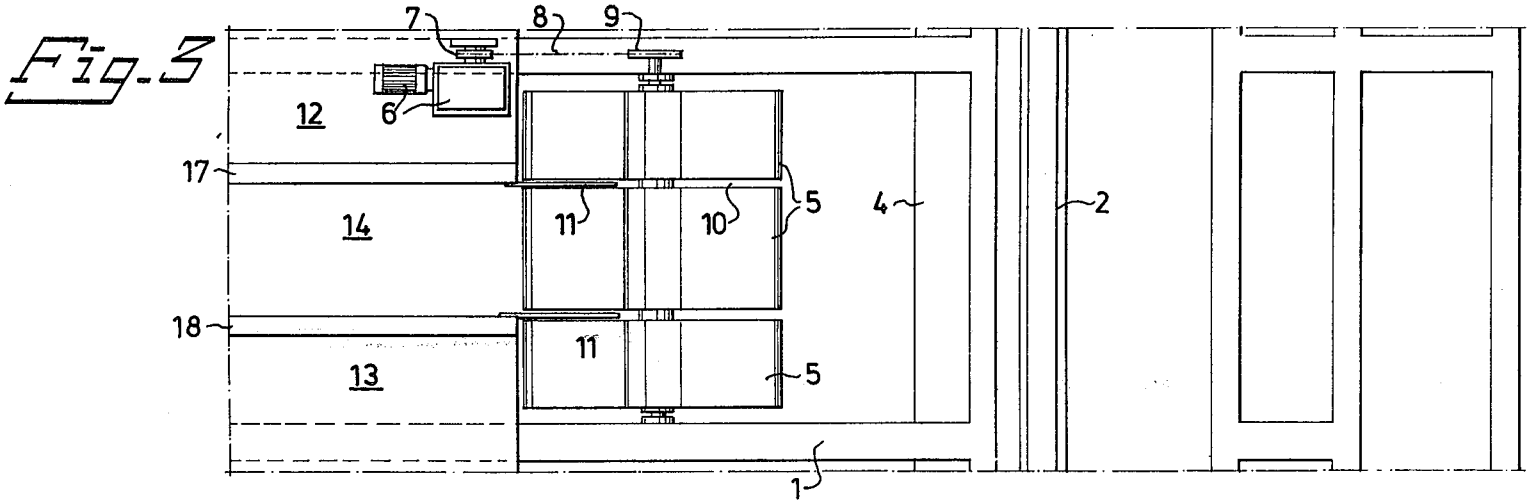
FIG. 3 shows the end shown in FIG. 1 as seen from above.

At the right basin end portion illustrated in FIGS. 1 and 3 the pieces of lumber to be soaked and thereby made softer by the hot water so that they are prepared for subsequent veneer turning or the like, are fed into the basin. Outside of the infeeding end of the basin 1 there is a longitudinal conveyor 2 feeding pieces of lumber 3. Those pieces of lumber, the lengths of which being less than 3 m, are tipped into the 3 m basins, and those pieces of lumber, the lengths of which being less than 2 m are tipped into the 2 m basin. The pieces of lumber 3 are tipped over a tipping plate 4 at the right short end of the basin in FIGS. 1 and 3, said basin being filled with water to for example two-thirds of its height.

At the infeeding end of the basin there if a compression wheel 5 constructed as a star wheel and driven in the direction indicated by the arrow in FIG. 1 at a low speed, for example 3–4 rotations per minute, by a worm gear motor 6 with a chain wheel 7 on a breaking clutch and a chain 8 in engagement with a chain wheel 9 on the shaft of the compression wheel. The compression wheel is vertically adjustable within certain limits, for example 400 mm.

Figure 5:
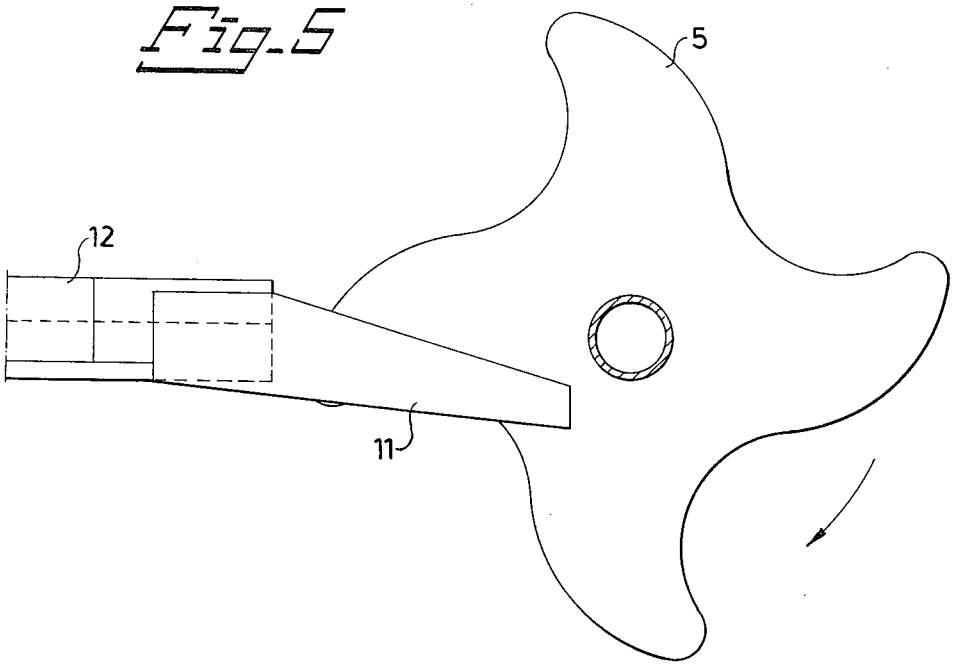
FIG. 5 shows on a greater scale a side view of a detail in the basin.

The compression wheel 5 has almost the same length as the basin is wide and is divided into three coaxial portions, see FIG. 3, by two deep grooves or slots 10 extending around said wheel and radially inwards to its hub. A stopper 11 extends into each deep slot 10, see also FIG. 5. Said stoppers 11 are thus located a little inside of the end surfaces of the compression wheel and can efficiently prevent pieces of lumber moved by the wheel from following the rotation of the wheel. The compression wheel 5 feeds the pieces of lumber 3 further to the left in FIGS. 1 and 3 at the same rate as new pieces of lumber are tipped into the basin.

Figure 2:
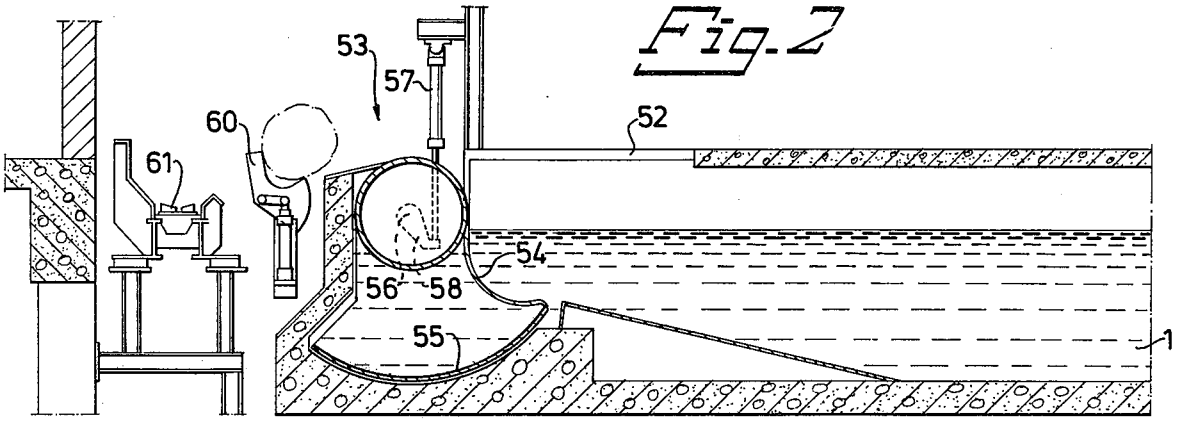
FIG. 2 shows a vertical longitudinal section through the other end of the same soaking basin and the parts arranged at the same, which parts, however, are not included in the present invention.
Figure 4:
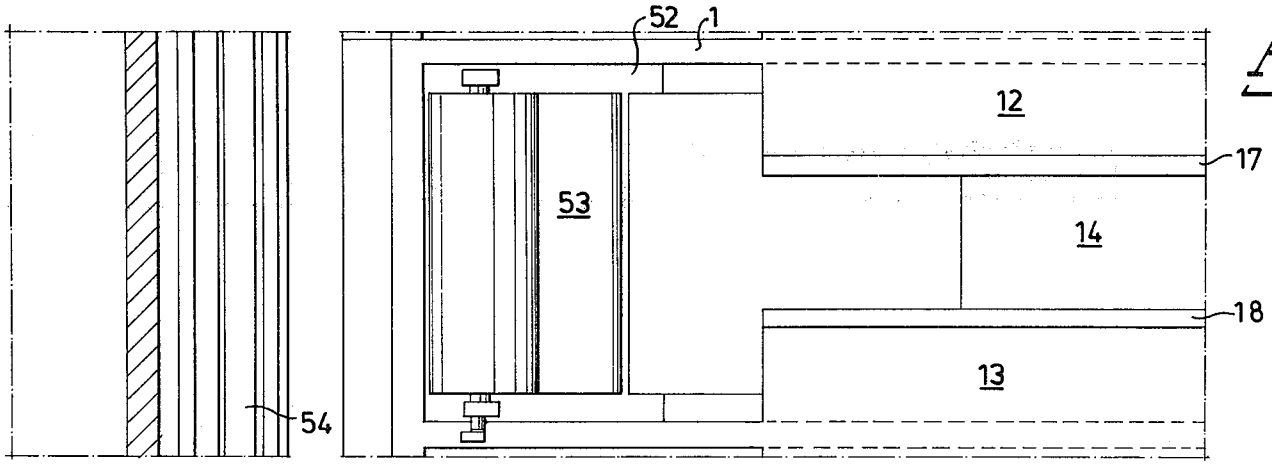
FIG. 4 shows the end shown in FIG. 2 as seen from above.
Figure 6:
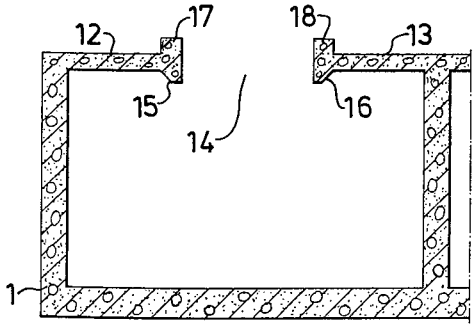
FIG. 6 shows a vertical cross section through the soaking basin.

The soaking basin 1 is covered by deck portions 12, 13, extending inwards from the longitudinal sides of the basin, see FIG. 6, between the compression wheel 5 and a lumber lifting device to the left in FIGS. 2 and 4. Between the deck portions 12, 13 there is formed a wide gap 14 and at the longitudinal edges thereof each of said deck portions 12, 13 is provided with a downwardly projecting edge border 15 and 16 respectively and an upwardly projecting longitudinal beam 17 and 18 respectively.

Figure 7:
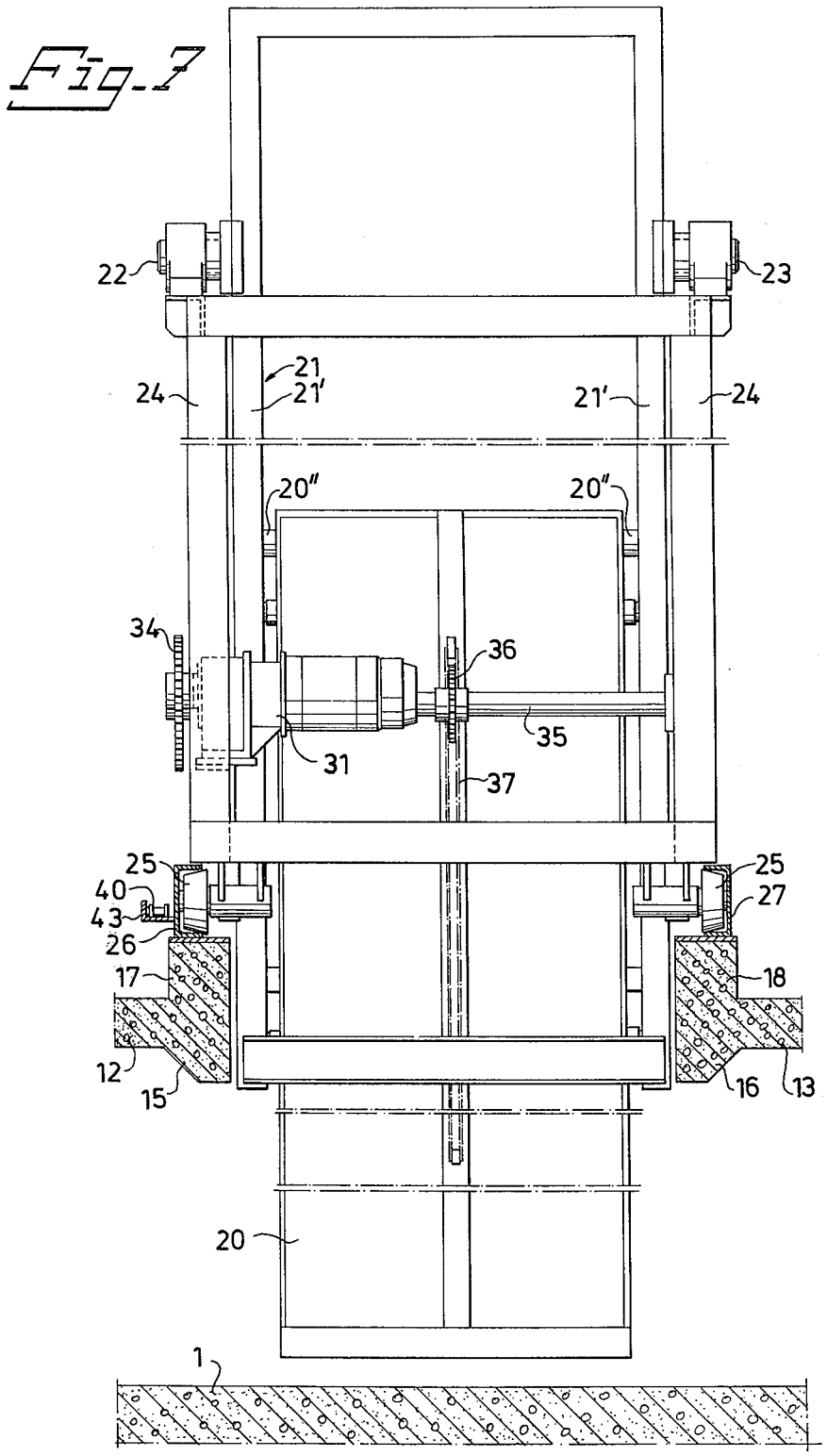
FIGS. 7–9 show on a larger scale various side views of a device movable on the soaking basin, but with some details located behind omitted for the sake of clarity.
Figure 8:
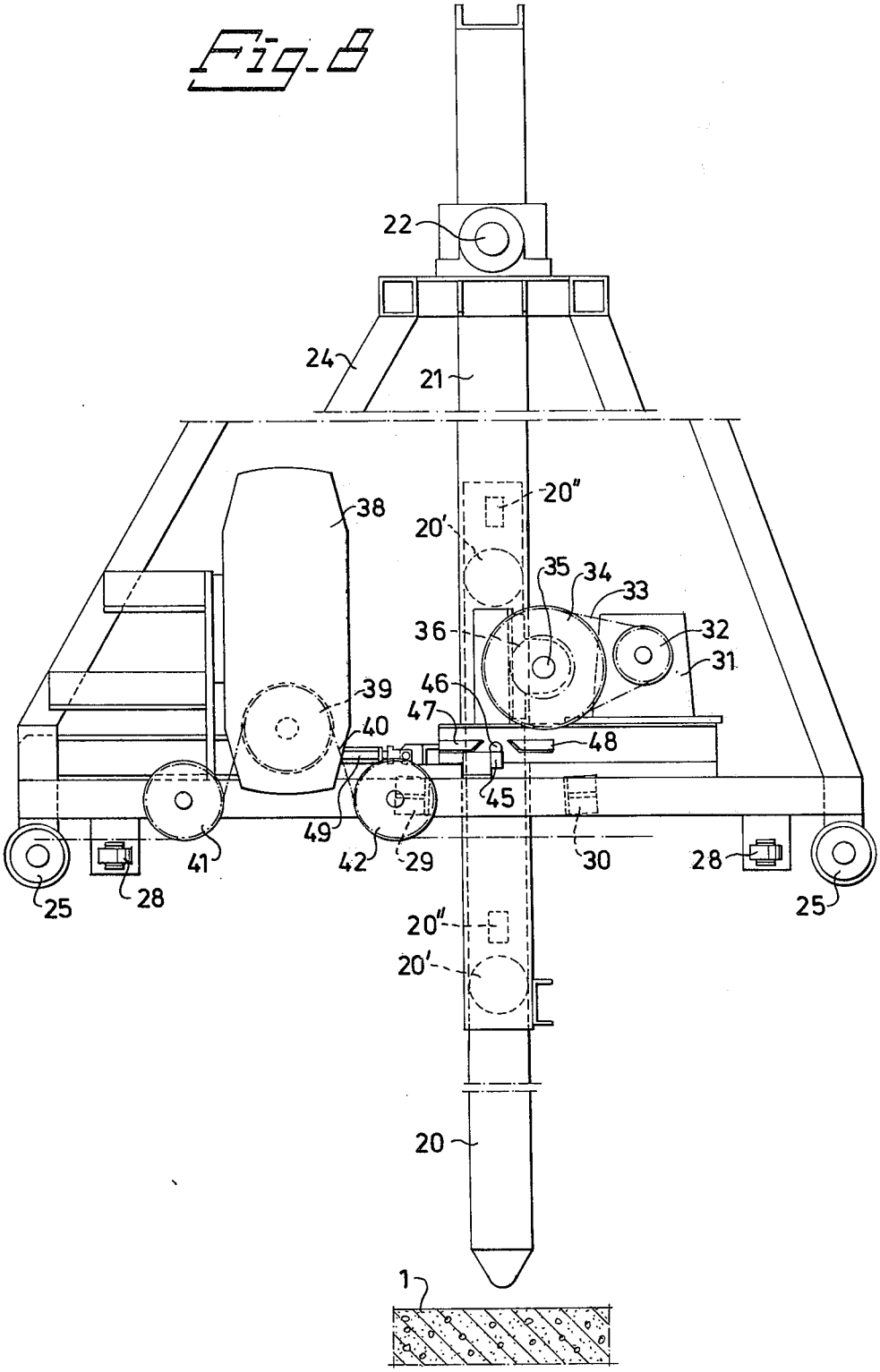
Figure 9:
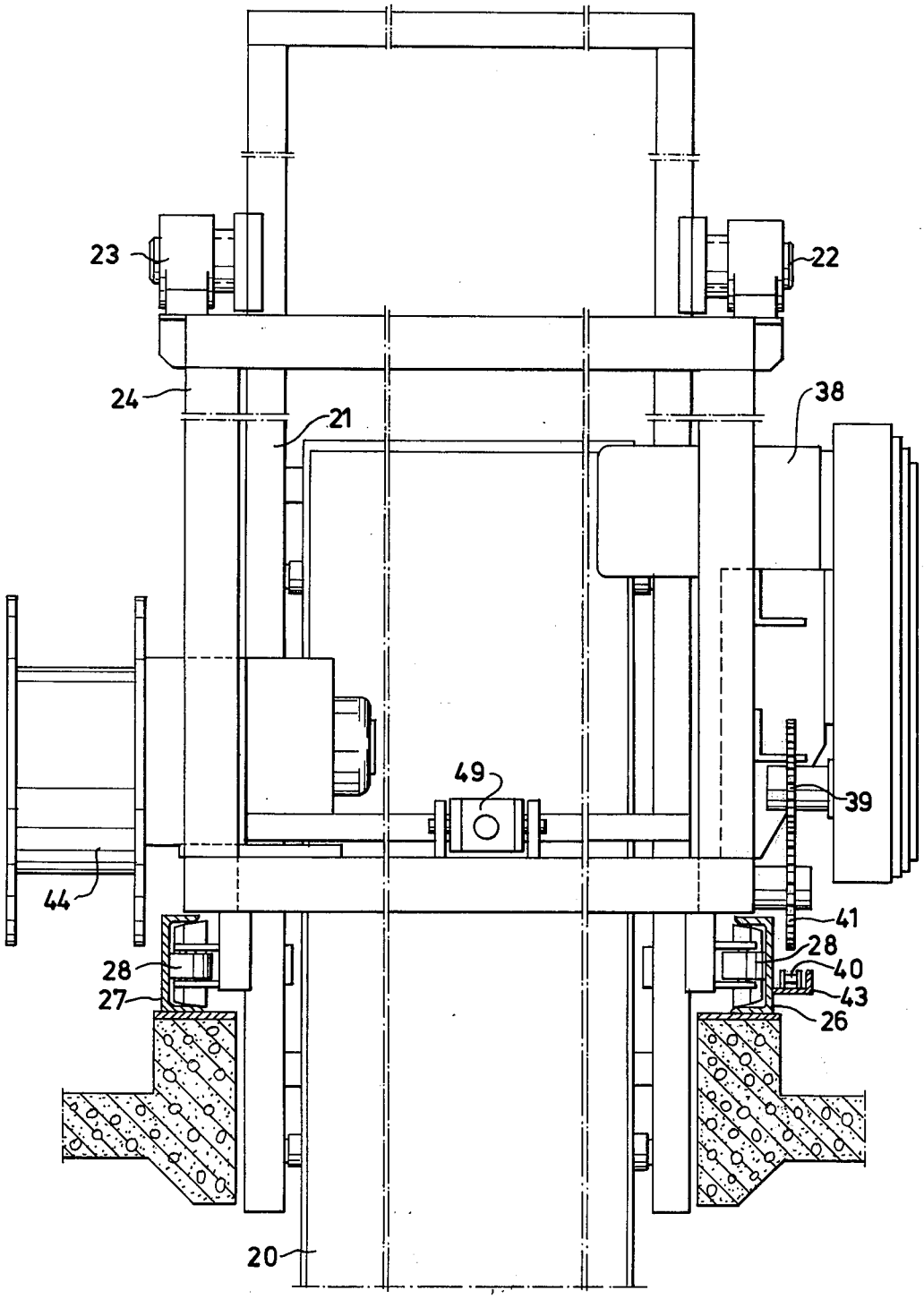

After the compression wheel 5, in the lumber feeding direction, there is a vertical screen 20, a part of which being only schematically indicated by dash-and-dot lines in FIG. 1, but completely illustrated in FIGS. 7–9. Said screen 20 extends downwards into and across the gap 14, and is almost as wide as the gap 14, see FIG. 7 and 9. The screen 20 is vertically movable guided in a pendulum 21, see FIGS. 7–9. The pendulum 21 is made of U-girder and has the shape of a rectangular frame, two vertical parts 21' of which having the flanges of the U-girder directed towards each other and forming guiding means for guiding wheels 20' and guiding pins 20'' of the guide screen 20, see FIG. 8. Hereby the screen easily will be vertically slidable and guided by the cradle.

The pendulum 21 is swingably journalled by shaft pivots 22, 23 in a frame 24 formed by beams, said frame 24 being provided with driving wheels 25 and guiding wheels 28 disposed in rails 26, 27. Said rails 26, 27 can consist of U-girders and are attached to the longitudinal beams 17 and 18 respectively. The frame 24 will thereby be a carriage frame. The pendulum 21 can swing between a pair of stops 29 and 30 of the frame 24, see FIG. 8.

A geared motor 31 is attached to the pendulum 21, see FIGS. 7, 8, with chain wheels 32. Said chain wheels are in driving connection with a chain wheel 34 by a chain 33. On the shaft 35 of the chain wheel 34 there is arranged a chain wheel 36 in engagement with a vertical roller chain 37, the ends of which being attached to the screen 20. Hereby the screen 20 is vertically movable relative to the pendulum 21. In its lower position the screen 20 almost reaches the bottom of the basin and in its upper position it has its lower edge somewhat higher than the lower surfaces of the downwardly projecting deck borders 15, 16.

A telpher device 38 is arranged in the frame 24, see FIGS. 8, 9, having chain wheels 39 in engagement with a chain 40. Said chain 40 extends over breaking wheels 41, 42 along the rail 26 in a protection rail 43 attached thereto, the ends of said chain 40 being fastened to one of said rails. The carriage frame will hereby be movable along the rails 26, 27 by the telpher device 38. On the frame 24 there is suitably a cable drum 44 for a current supply cable to the electric motors of the carriage frame.

In the current supply circuit of the telpher device 38 there is an end position switch 45 arranged on the frame 24. An operating arm 46 of said switch 45 can alternatively be influenced by a pair of contact members 47, 48, which are adjustably arranged on the pendulum 21. A preferably springing buffer means 49 with displaceable and articulated parts is located between the carriage frame 24 and the pendulum 21 to make the pendulum have a vertical position when not influenced by other forces.

At the left end of the basin 1, see FIGS. 2 and 4, there is arranged a lumber outfeeding opening 52 and a lumber lifting device 53, which however is no part of the present invention but intended to be used together with the construction described above. Said lumber lifting device 53 comprises a lifting means having a concave lifting surface 54 and a stop surface 55. Said lifting means can be rotated about a shaft 56 and is driven by a hydraulic device 57, which cooperates with a crank arm 58. In the position shown by full lines in FIG. 2 pieces of lumber fed through the basin 1 will be moved onto the lifting surface 54, possibly by an inclined surface 59 on the bottom of the basin. When the lifting means is turned to the position shown by dash-and-dot lines in FIG. 2, the piece or the pieces of lumber moved onto the surface 54 will be lifted out of the basin to a single piece feeding means 60, which feeds the pieces of lumber one by one to a longitudinal conveyor 61.

However, the lumber lifting device 53 can be replaced by a chain lift or the like.

The function of the device described above is as follows. Pieces of lumber 3 are fed by the longitudinal conveyor 2 and tipped into a basin suitable for their lengths. The basin is filled with hot water to about 2/3. The water level is kept constant by a level regulator, so that the feeding of the pieces of lumber will not be stopped by the downwardly projecting borders 15, 16. The compression wheel 5 will rotate and thereby catch pieces of lumber and feed them to the screen 20, said pieces of lumber lying in the transverse direction of the basin. The screen 20 is in its initial position near the compression wheel 5 and is lowered to its position near the basin bottom. Since the screen 20 is directed in the transverse direction of the basin, the pieces of lumber will be kept between the screen and the compression wheel in the transverse direction of the basin. Thus they can not come to lie in the longitudinal direction of the basin and thereby hinder the operation.

The pressure of the pieces of lumber against the screen 20 will bring this one to swing together with the pendulum 21 against the action of the buffer means 49. Thereby the contact member 47 will influence the operating arm 46, so that the end position switch 45 will close the circuit to the telpher device 38, which will drive the carriage frame 24 forwards in the lumber feeding direction, until the pressure on the screen 20 will be smaller so that said screen can return to its normal vertical position. Thereby the end position switch will stop the current supply, and the telpher device and thereby also the carriage frame will stop. The screen 20 has thus been moved only a short distance and its guiding influence on the pieces of lumber for maintaining them in the transverse direction has not ceased. The spring in the buffer means 49 is intended to keep the screen in the vertical neutral position. Due to the pressure obtained thereby the pieces of lumber that are pressed against the screen will be packed together and partly pressed down into the water, whereby a great part of the space between the basin bottom and the borders 15, 16 will be filled with pieces of lumber. However, the spring force must not be so strong, that the pieces of lumber will be pressed against the basin bottom and/or reach up to the borders 15, 16, as in that case the pieces of lumber may lock each other and thereby interruptions may occur in the operation. By the device described about three times as many pieces of lumber can lie in the basin at the same time compared with other devices, in which the pieces of lumber lie in one layer at the water surface. The procedure of stepwise movement of the screen and the carriage frame is influenced by a growing number of pieces of lumber driven forward by the compression wheel 5, until the basin is filled to a substantial degree with pieces of lumber and the screen 20 has reached its end position at the lumber outfeeding opening 52. Thereby the level regulator will be changed, so that the water level in the basin will rise to be somewhat higher than the undersides of the downwards projecting borders 15, 16. Said borders will stop the pieces of lumber from flowing so high, that any part of them will be above the water surface. In other words, the pieces of lumber will in a reliable way be kept covered by hot water. Which is a necessary condition if the pieces of lumber are to be used later for veneer production for example.

When the pieces of lumber have been soaked in the hot water at the required temperature for for example 12 hours, the screen will be lifted by the geared motor 31 and the transmission means 32–37, and the carriage frame 24 will be driven to its initial position, where the screen 20 is lowered close in front of the compression wheel 5. Thereafter the carriage frame 24 will be driven forwards, and the pendulum 21 together with the screen 20 will be swung backwards by the pressure of the screen on the pieces of lumber. The end position switch will be influenced by the contact member 48 and the carriage frame will not be driven, until the screen 20 has returned to its normal position because pieces of lumber have been removed from the basin by the lifting device 53. Thereafter the carriage frame can be further moved.

If a piece of lumber should get stuck on the bottom, a plate can be fastened to the lower part of the screen and the carriage frame can be driven to the end position, where the piece of lumber can be lifted in some suitable way.

By the device according to the invention those advantages are especially obtained, that the pieces of lumber when fed through the long basin are kept by force close to each other transversely directed in the basin. Thereby they can not cause any interruptions of the operation by taking wrong positions. Furthermore, the whole device can be an operating link directly between a longitudinal conveyor for lumber supply and a longitudinal conveyor for further feeding of the pieces of lumber. All the driving means can be automatically driven at a suitable speed relative to each other for feeding the pieces of lumber in the basin. Furthermore, a great number of pieces of lumber can be treated simultaneously in one basin.

The invention is not restricted to only the embodiment described and illustrated in the drawings, as it can be modified within the scope of the invention. The number of basins in a plant and the widths of the basins can be varied depending on the lengths of the lumber to be treated. The positions of the downwards projecting borders and the upwards projecting longitudinal beams of the deck portions can be varied horizontally. The width of the screen relative to the width of the basin can be varied, and the screen need not be of solid plate. Instead it can be for example a grating or a net or a gate. The pendulum can be replaced by a fixed means if some other control means than the end position switch is used for the stepwise feeding. Various kinds of driving and transmission means can be used.

What I claim is:

1. A device for an elongate soaking basin for transverse feeding of pieces of lumber, preferably lumber intended for veneer production, in the longitudinal direction of the basin, including a compression wheel arranged at the lumber infeeding end of said basin to feed said pieces of lumber forward in the basin to a lumber outfeeding end, comprising:

a vertical screen vertically movable into and out of said basin by a motor, said screen supported by a frame and having its plane transverse to the longitudinal direction of said basin;

said frame being longitudinally driveable above said basin by a driving motor, to move said screen between its initial position at said compression wheel and its end position at said lumber outfeeding end of said basin;

said frame including means for providing compression of said pieces of lumber against one of said outfeeding end or said compression wheel; and said frame including means responsive to said compression for starting and stopping said driving motor.

2. A device according to claim 1 wherein:

said basin is provided with a lumber lifting device at said outfeeding end, for feeding said pieces of lumber to a longitudinal conveyor at the basin end.

3. A device according to claim 1 wherein:

said driving motor is an electric motor;

said screen is suspended and guided for vertical movement in a pendulum;

said pendulum being pivotally suspended between a first and second end position;

said means for starting and stopping said driving motor including a contact secured to said frame at each of said end positions, for electrically connecting with an end position switch when said screen is pivoted into contact with one of said end position contacts;

said end position switch being connected to an electric power circuit for said driving motor, thereby supplying a current supply to said motor when said end position switch is in contact with one of said contacts, thereby moving said frame and screen step by step to said end position at the lumber outfeeding end of said basin.

4. A device according to claim 3 wherein:

said pendulum pivots between said end positions by said means for providing compression including springing buffer means working to bring said pendulum back to a substantially vertical position.

5. A device according to claim 3 wherein:

said basin is covered by deck portions from said compression wheel to a lumber outfeeding opening at said lumber outfeeding end, said deck portions extending from the longitudinal sides of said basin;

a longitudinal gap being formed between said deck portions;

said deck portions each being provided with a border at said gap, said border projecting downward a short distance;

whereby said pieces of lumber will be retained under the lower edges of said borders when the water level is high.

6. A device according to claim 5 wherein:

each of said deck portions supports a rail on its upper side, extending in the longitudinal direction of said basin; and said frame including driving wheels and guiding wheels disposed in contact with said rails.

7. A device according to claim 3 wherein:

said pendulum includes a geared motor with a chain wheel in driving engagement with a chain coupled to said chain wheel and to a second chain wheel, said second chain wheel mounted on a substantially horizontal shaft including a third chain wheel in engagement with a second chain, said second chain extending vertically along and being fastened by its ends to said screen.

8. A device according to claim 1 wherein:

said basin is covered by deck portions from said compression wheel to a lumber outfeeding opening at said lumber outfeeding end, said deck portions extending from the longitudinal sides of said basin;

a longitudinal gap being formed between said deck portions;

said deck portions each being provided with a border at said gap, said border projecting downward a short distance;

whereby said pieces of lumber will be retained under the lower edges of said borders when the water level is high.

9. A device according to claim 8 wherein:

each of said deck portions supports a rail on its upper side, extending in the longitudinal direction of said basin; and said frame including driving wheels and guiding wheels disposed in contact with said rails.

10. A device according to claim 9 wherein:

said driving motor includes a chain wheel in engagement with a chain, said chain extending over braking wheels located near one of said rails, and a protection rail arranged on said rail; and said chain having its ends fastened to one of said rail or said protection rail.

11. A device according to claim 8 wherein:

said compression wheel includes at least two radial grooves;

each of said deck portions including a stopper extending into one of said grooves to prevent said pieces of lumber from following the rotation of said compression wheel.

* * * * *